US005738011A

United States Patent [19]

Tay

[11] Patent Number: 5,738,011

[45] Date of Patent: Apr. 14, 1998

[54] AMUSEMENT STAMP

[76] Inventor: Hsu Ming Tay, No. 3, Chung Tai Rd., Chun-Li, Taoyuan Hsien, Taiwan

[21] Appl. No.: 787,338

[22] Filed: Jan. 27, 1997

[51] Int. Cl.[6] ..... B41L 47/02

[52] U.S. Cl. ..... 101/368; 101/372; 101/405

[58] Field of Search ..... 101/368, 372, 101/379, 405, 406

[56] References Cited

U.S. PATENT DOCUMENTS

| | | | |
|---|---|---|---|
| 1,069,356 | 8/1913 | Tilden | 101/379 |
| 2,382,804 | 8/1945 | Morrison | 101/379 |
| 3,158,096 | 11/1964 | Arnold | 101/368 |
| 4,127,063 | 11/1978 | Peterson | 101/368 |
| 5,579,692 | 12/1996 | Collier | 101/368 |

*Primary Examiner*—Edgar S. Burr
*Assistant Examiner*—Anthony H. Nguyen
*Attorney, Agent, or Firm*—W. Wayne Liauh

[57] ABSTRACT

Disclosed is an amusement stamp for children which includes a light-pervious ornament removably but tightly fitted on an ornament seat, an outer ring member, a retractable stamp seat having a design-bearing lower head and being supported in the outer ring member, a spring disposed in the outer ring member around the stamp seat, and a bottom cover for protectively closing the design-bearing lower head of the retractable stamp in a bottom opening of the outer ring member. The ornament seat is connected to a top edge of the outer ring member and compresses the spring between it and the retractable stamp seat. A small bulb is mounted on a top of the ornament seat and can be turned on or off via a pushbutton sideward projected from a side wall of the ornament seat. When a child uses the amusement stamp to imprint a pattern on something, the design-bearing lower head of the retractable stamp seat is pushed upward and depresses the pushbutton to lighten the small bulb, creating more funs for the stamp.

1 Claim, 4 Drawing Sheets

AMUSEMENT STAMP

BACKGROUND OF THE INVENTION

An amusement stamp is one of the favorite toys of children. The amusement stamps usually provide cute imprints, such as animals, plants, beautiful designs, etc. Many teachers in kindergartens and primary schools use amusement stamps to print these lovely patterns on notebooks of students as an encouragement and praise to the students.

Presently commercially available amusement stamps usually include a design-bearing head fixed to a handle. Such amusement stamps only provide children with some amusing imprints. There are some amusement stamps with ornaments attached to a rear end of the handle in an attempt to provide more fun and attract more children. There are also sound or light emitting amusement stamps developed by some manufacturers. These sound or light emitting amusement stamps need components such as circuit board, buzzer, etc. which also increase the manufacturing cost of the amusement stamps. On the other hand, most children tend to easily get bored with the same toy, including the amusement stamp. That means the amusement stamps are consumptive items which will lose consumers' interest in them if the price thereof is too high. As a result, there is few sound and/or light emitting amusement stamps prevailing on the market.

SUMMARY OF THE INVENTION

It is therefore a primary object of the present invenion to provide a light-emitting amusement stamp for children. The light-emitting amusement stamp according to the present invention is provided with an ornament seat to receive a light-pervious ornament on a top thereof. When the stamp is used to print, a lower retractable head with pattern is depressed inward and thereby closes a circuit in the ornament seat, lightening a small bulb on the top thereof so that light emits through the ornament to create more funs. The ornament is removably connected to the ornament seat and therefore can be freely replaced with other ornaments to meet children's individual preference.

Another object of the present invention is to provide a light-emitting amusement stamp for children which has simple structure and low manufacturing cost and can therefore be widely accepted by consumers while creating more funs.

DETAILED DESCRIPTION OF THE PREFERRED EMBODIMENT

Figure 1:
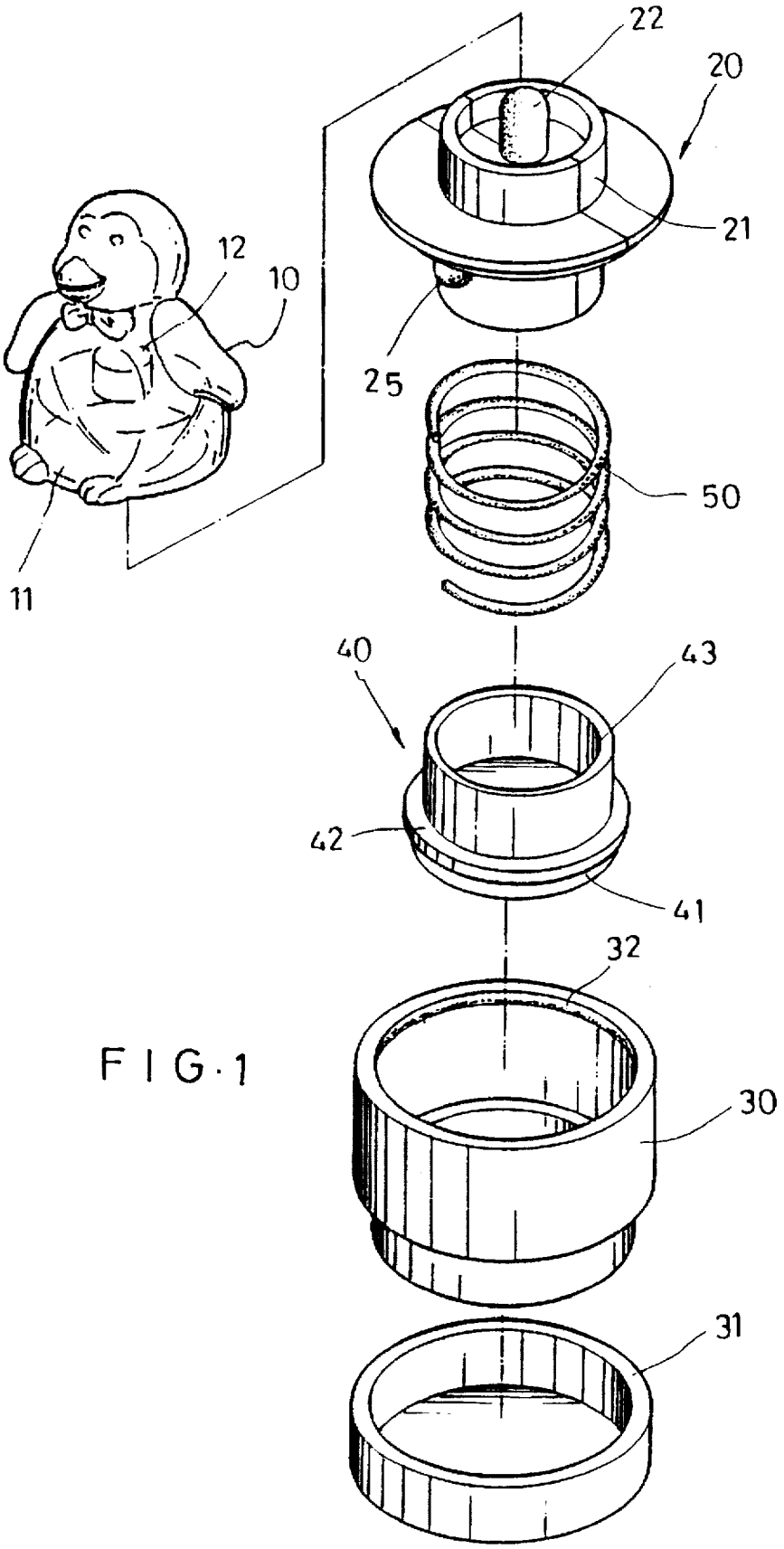
FIG. 1 is an exploded perspective of a preferred embodiment of the present invention.
Figure 2:
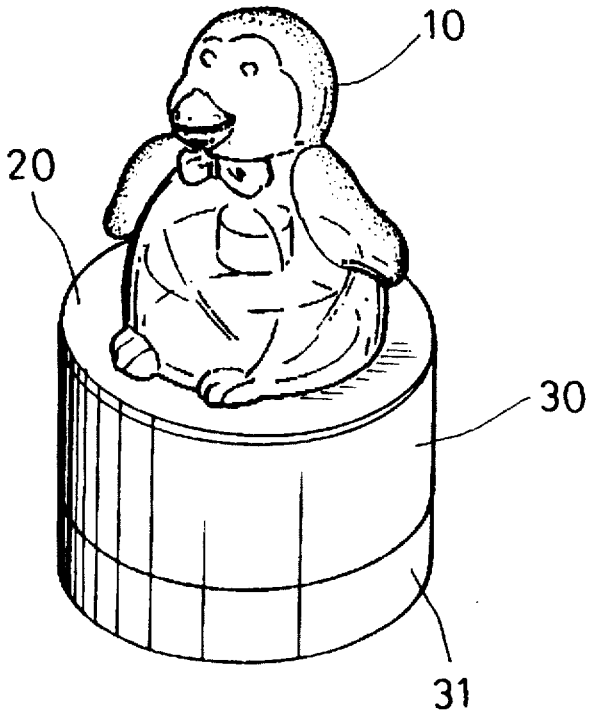
FIG. 2 is an assembled perspective of the present invention shown in FIG. 1.
Figure 3:
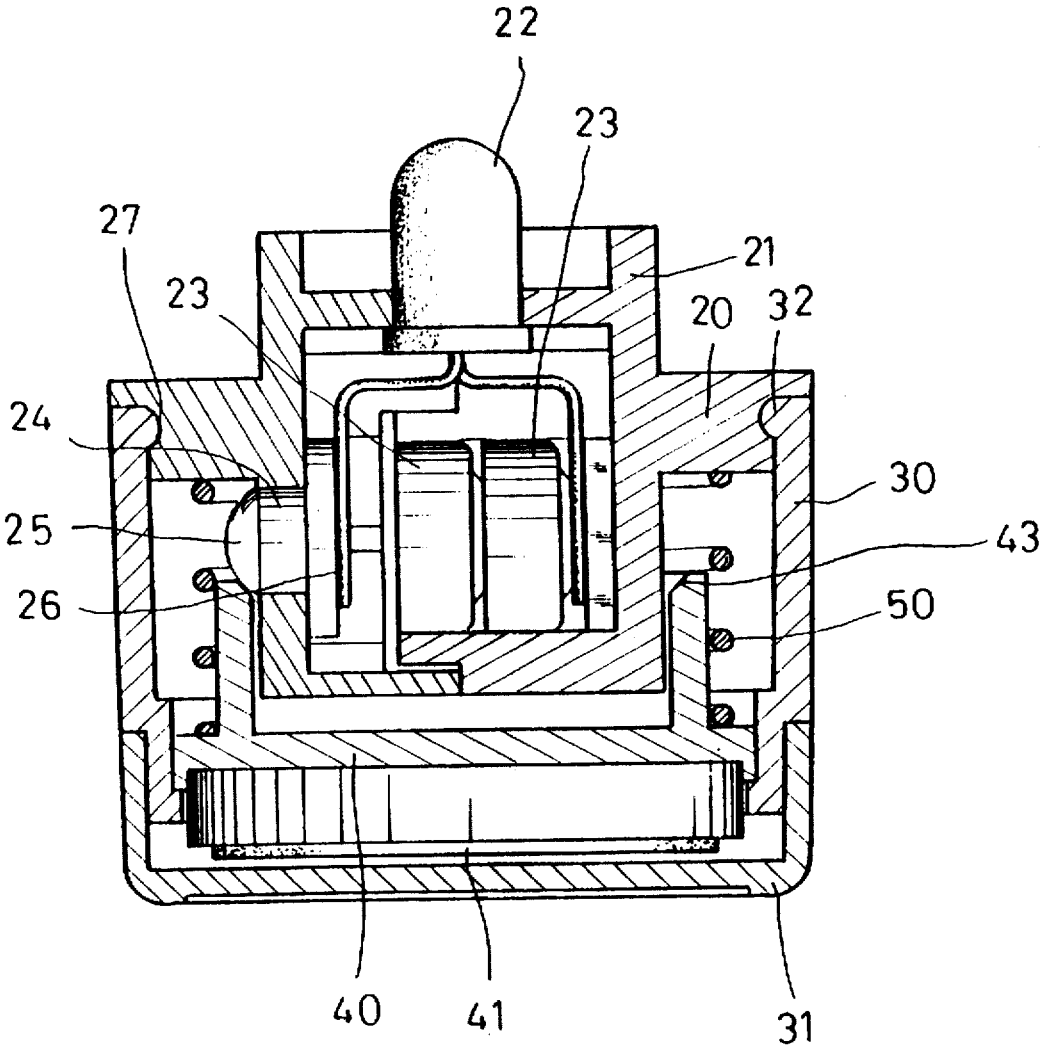
FIG. 3 is an assembled sectional view of the present invention shown in FIG. 2.
Figure 4:
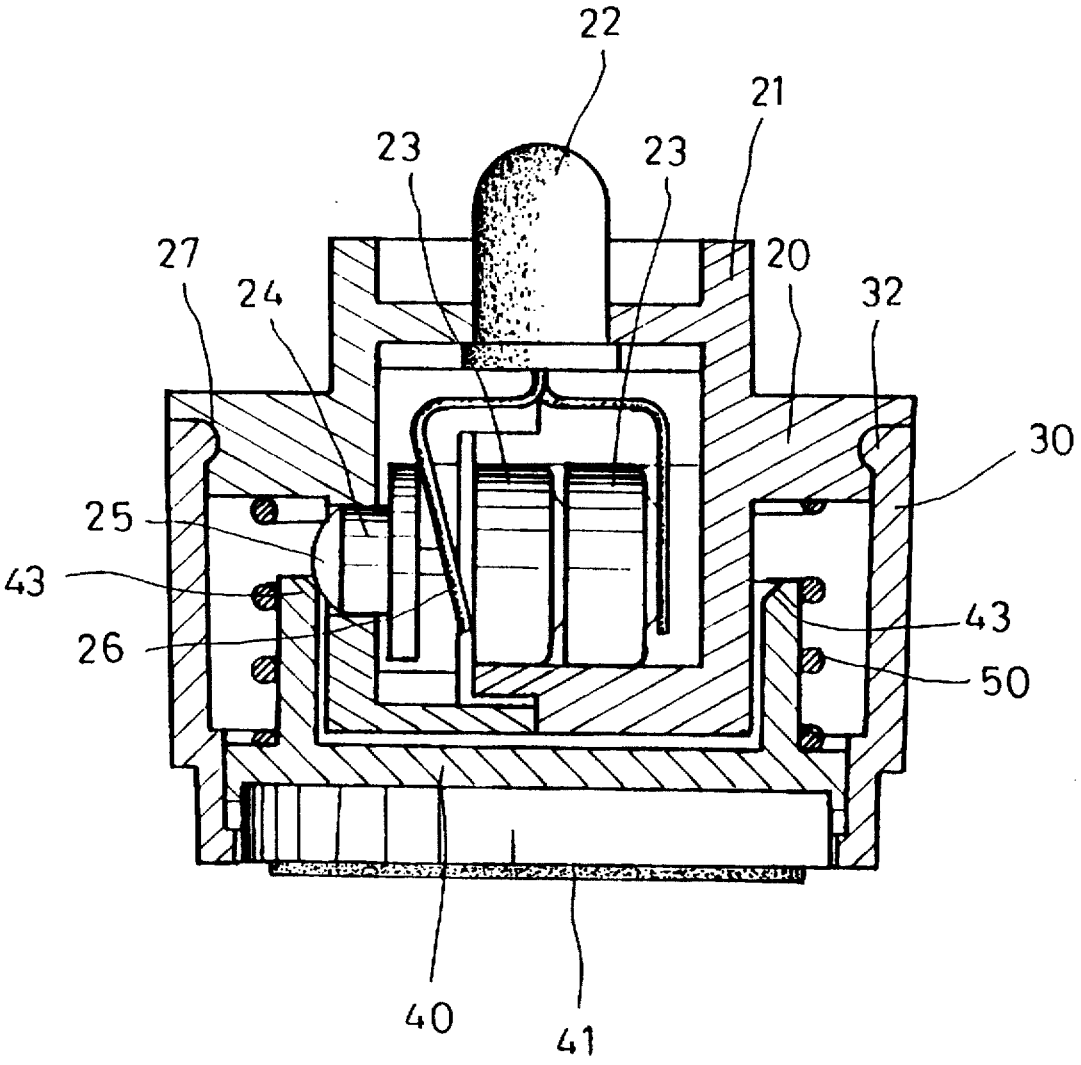
FIG. 4 is similar to FIG. 3 showing the present invention in use.

Please refer to FIGS. 1 through 4. The present invention relates to an improved amusement stamp which mainly includes a light-pervious ornament 10, an ornament seat 20, an outer ring member 30, a retractable stamp seat 40 with a design-bearing lower head 41, a spring 50, and a bottom cover 31 for closing a lower opening of the outer ring member 30.

The ornament 10 has a lower inner recess 11 and a hole 12 with reduced diameter centered at a top of the recess 11.

The ornament seat 20 has an upward projected ring portion 21 defining a round space inside it. A small bulb 22 is mounted at a center of the round space and is powered by a battery 23 disposed inside the ornament seat 20. A pushbutton 24 having a round head 25 is provided to a lower side wall of the ornament seat 20 to contact with an elastic electrode 26 of the small bulb 22. The round head 25 of the pushbutton 24 sideward projects from the lower side wall of the ornament seat 20. When the round head 25 is pushed inward, the small bulb 22 is on, and when the round head 25 is released, the small bulb 22 is off. An annular groove 27 is formed around an outer periphery of the ornament seat 20.

The outer ring member 30 has two open ends. An annular rib 32 with rounded head is formed around an inner wall surface of the ring member 30 near a top edge thereof. An annular flange 33 is formed around the inner wall surface of the ring member 30 near a bottom edge thereof.

The design-bearing lower head 41 is fixed to the retractable stamp seat 40. A circle of flange 42 is formed around an outer wall surface of the stamp seat 40 near a lower portion thereof. The flange 42 has an outer diameter smaller than an internal diameter of the outer ring member 30 but larger than an internal diameter of the flange 33 of the outer ring member 30. The stamp seat 40 includes a ring portion above the flange 42. An inner top edge of the ring portion of the stamp seat 40 forms an inward and downward inclined surface 43.

The retractable stamp seat 40 is disposed in the outer ring member 30 with the flange 42 supported on the flange 33, preventing the stamp seat 40 from falling out of the outer ring member 30. The spring 50 is disposed in the outer ring member 30 with a lower end of the spring 50 pressing against the flange 42 of the retractable stamp seat 40 to normally push the lower head 41 of the retractable stamp seat 40 to downward project out of the outer ring member 30. The ornament seat 20 is connected to the outer ring member 30 by engaging the groove 27 around the outer periphery of the ornament seat 20 with the rounded rib 32 around the top edge of the outer ring member 30. The spring 50 disposed inside the outer ring membeer 30 is compressed between the ornament seat 20 and the retractable stamp seat 40. The ornament 10 is put on the ornament seat 20 with its lower inner recess 11 tightly fitting around the upward projected ring portion 21 of the ornament seat 20 and the small bulb 22 extending into the hole 12 centered at the top of the recess 11. The bottom cover 31 is covered to the lower opening of the outer ring member 30 so as to protectively seal the design-bearing lower head 41 of the retractable stamp seat 40 in the outer ring member 30.

When the amusement stamp of the present invention is used to imprint a pattern on something, the retractable stamp seat 40 is subjected to an upward pressure and is therefore pushed upward. At this point, the inclined surface 43 of the inner top edge of the retractable stamp seat 40 contacts with and presses the round head 25 of the pushbutton 24 inward to lighten the small bulb 22. When the stamp is not in use and the upward pressure vanishes, the retractable stamp seat 40 is pushed to its lower position by the spring 50 and the pushbutton 24 is released to its outward position, and the small bulb 22 extinguishes, accordingly.

The ornament seat 20 of the present invention includes two halves which snap together to form a complete ornament seat 20. The small bulb 22, the battery 23, and the pushbutton 24 all are put into the ornament seat 20 before the two halves are snapped together. When the two halves of the ornament seat 20 are snapped together, the small bulb 22 is located in the upward projected ring portion 21 and the pushbutton 24 sideward projects from the ornament seat 20. The small bulb 22 has two elastic long electrodes 26 looking like two antennae. When the pushbutton 24 is depressed, it contacts with one of the long electrodes 26 and closes a circuit controlling the small bulb 22 and lightens the small bulb 22. When the pushbutton 24 is released from an outcoming force, the elastic electrode 26 automatically pushes the pushbutton 24 to its home position, disconnecting the circuit and the small bulb 22.

The circuit in the present invention is very simple and includes only a small bulb 22 and batteries 23. When a child uses the amusement stamp of the present invention to imprint some pattern on something, the retractable stamp seat 40 is naturally depressed and retracts, and therefore lightens the small bulb 22. And, when the amusement stamp is not in use, the bulb 22 automatically extinguishes. The turning on and off of the small bulb 22 creates funs to the children using the amusement stamp of the present invention.

The ornament 10 is removably attached to the ornament seat 20 by tight fit. Thus, different ornaments 10 can be freely used to replace the old one, increasing the funs of the amusement stamp.

What is claimed is:

1. An amusement stamp, comprising a light-pervious ornament, an ornament seat, an outer ring member, a retractable stamp seat having a design-bearing lower head, a spring, and a bottom cover for closing a lower opening of said outer ring member;

said ornament having an lower inner recess and a hole with reduced diameter centered at a top of said recess;

said ornament seat having an upward projected ring portion defining a round space thereinside, a small bulb centered in said round space, batteries mounted inside said ornament seat for supplying power to said small bulb, and a pushbutton mounted on a side wall of said ornament seat with a round head sideward projected from said side wall; said ornament seat also having an annular groove formed around an outer periphery thereof;

said outer ring member having two open ends and being formed on an inner wall surface near a top edge with an annular rib having round head and near a bottom edge with an annular flange; and said retractable stamp seat with said design-bearing lower head including a lower flange portion which has an outer diameter smaller than an internal diameter of said outer ring member but larger than an internal diameter of said flange near bottom edge of said outer ring member, and an upper ring portion above said flange portion; said ring portion having an inner top edge forming an inward and downward inclined surface;

wherein said retractable stamp seat being disposed in said outer ring member with said lower flange portion of said stamp seat supported on said annular flange of said outer ring member, said spring being disposed in said outer ring member with a lower end pressing against said lower flange portion of said retractable stamp seat, said ornament seat being connected to said outer ring member by engaging said groove around the outer periphery of said ornament seat with said rounded rib around the inner top edge of said outer ring member and thereby normally compressing said spring disposed in said outer ring member against said lower flange portion of said retractable stamp seat, said ornament being put on said ornament seat with said lower inner recess tightly fitting around the upward projected ring portion of said ornament seat and said small bulb extending into said hole centered at the top of said recess, and said bottom cover being removably covered to the lower opening of said outer ring member to protectively seal said design-bearing lower head of said retractable stamp seat;

whereby when said amusement stamp is in use, said design-bearing lower head of said retractable stamp seat is pushed upward with the inclined inner top edge thereof contacting with and pressing said round head of said pushbutton inward to lighten said small bulb, and when said amusement stamp is not in use, said design-bearing lower head of said retractable stamp seat is pushed down by said spring, said pushbutton is released, and said small bulb extinguishes.

* * * * *